United States Patent [19]

Beck et al.

[11] Patent Number: 4,900,170

[45] Date of Patent: Feb. 13, 1990

[54] RELOADABLE ENDLESS RIBBON CASSETTE

[75] Inventors: Dieter Beck, Setzingen; Gerhard Lohrmann, Elchingen, both of Fed. Rep. of Germany

[73] Assignee: Mannesmann AG, Duesseldorf, Fed. Rep. of Germany

[21] Appl. No.: 693,177

[22] Filed: Jan. 22, 1985

[30] Foreign Application Priority Data

Jan. 24, 1984 [DE] Fed. Rep. of Germany ..... 3402662

[51] Int. Cl.[4] ..... B41J 32/02

[52] U.S. Cl. ..... 400/196; 400/196.1; 400/234; 400/235.1; 400/208

[58] Field of Search ..... 400/194, 195, 196, 196.1, 400/207, 208, 208.1, 234, 235, 235.1

[56] References Cited

U.S. PATENT DOCUMENTS

| | | | |
|---|---|---|---|
| 4,113,750 | 9/1978 | Isobe | 400/196 X |
| 4,213,715 | 7/1980 | Haftmann et al. | 400/234 X |
| 4,240,757 | 12/1980 | Hanna | 400/196.1 |
| 4,273,453 | 6/1981 | Haftmann | 400/207 X |
| 4,325,645 | 4/1982 | Miyajima et al. | 400/208 X |
| 4,367,963 | 1/1983 | Daughters | 400/208 |
| 4,397,574 | 8/1983 | Wojdyla | 400/235.1 |
| 4,451,165 | 5/1984 | Fudatsuji et al. | 400/208 X |
| 4,526,487 | 7/1985 | Ikeda | 400/196.1 |

FOREIGN PATENT DOCUMENTS

| | | | |
|---|---|---|---|
| 0144518 | 11/1975 | Japan | 400/207 |
| 0077180 | 6/1981 | Japan | 400/208.1 |
| 0187287 | 11/1982 | Japan | 400/234 |
| 1439901 | 6/1976 | United Kingdom | 400/196.1 |

*Primary Examiner*—Ernest T. Wright, Jr.
*Attorney, Agent, or Firm*—Ralf H. Siegemund

[57] ABSTRACT

A ribbon cassette having a casing with a releasable cover, includes a pulley mounted for rotation in the casing, key-means project beyond the casing of the cassette for engagement with an external drive, a pressure roller is rotatably mounted in the case, a slide movably mounts the pressure roller to obtain a first position of engagement with the pulley and a second retracted position, a projection on the slide is externally accessible through an opening in the casing for shifting the slide from the first to the second position and vice versa; an additional projection on said slide runs in another opening in the casing for guiding movement of the slide along a long wall of the cassette casing; a brake is also disposed in the cassette which holds a removable endless ink ribbon that is insertible and inserted in the casing and fills the casing essentially in its entirety, the ribbon runs through a gap between the pulley and the pressure roller on one hand and the brake on the other.

3 Claims, 1 Drawing Sheet

RELOADABLE ENDLESS RIBBON CASSETTE

BACKGROUND OF THE INVENTION

The present invention relates to a cassette for an ink ribbon which includes a cassette casing and drive elements.

Cassettes of the type to which the invention pertains may include driven, journaled rollers (pulleys etc.) and friction means arranged between the ribbon and the roll or pulley whereby the roll or pulley is connected with a coupling element penetrating the cassette casing. Moreover such a cassette includes on the exit side a brake element and the casing is covered by a releasable cover.

Such ink ribbon cassettes particularly for colored ribbons and multicolor dyes are usable as exchange modules to be inserted for example in typewriters, printers including for example matrix printers and other office machines. Whenever a ribbon is to be exchanged the cassette as a whole is removed and replaced by a new one. This of course facilitates greatly the exchange of a spent ribbon for a fresh one, however this procedure entails a relatively expensive practice particularly if the cassette is subsequently just discarded.

Generally speaking it is also well known to consider one and the same cassette as being a more or less integral or associated element with the office machine to which it pertains and with which such a cassette cooperates. Under such aspect one may have for example another cassette just for the ribbon. When the ribbon is spent this exchange cassette is replaced by a fresh one in the basic cassette which remains in place. In other words there is a regular or basic cassette which includes traction means and a particular type of ribbon exchange cassette which is removably and replaceably inserted in the basic cassette to permit ready and easy exchange of the ribbon as so understood. This arrangement however has the drawback of a considerably larger space requirement for the ribbon exchange cassette within the basic cassette. Since the space to be occupied by any inserted cassette in the office machine is limited and since particularly length dimensions cannot be changed, it turns out that in the conventional device the ribbon exchange cassette for such a basic cassette occupies as such space in the latter which can come only from ribbon material so that the length of the ribbon to be accommodated is reduced. This means that the exchange has to take place in more frequent intervals. High performance printers i.e. high speed printers printing for example 400 characters per second consume in that sense ribbon material rather rapidly which in turn means that the exchange of ribbon slows down in effect the printer operation.

DESCRIPTION OF THE INVENTION

It is an object of the present invention to provide a new and improved ribbon exchange feature for and within ribbon cassettes for typewriters, office machines, or the like which does not require compromise as to ribbon length and may even permit reduction of cost as far as the ribbon exchange itself is concerned and as compared with the ribbon exchange features of the prior art.

The object of the present invention is attained in accordance with the preferred embodiment of the present invention by providing a cassette with a removable lid and the endless ribbon is directly placeable into said casing; there being a journaled, externally accessible keying means for connection to an external drive of the pulley, and the pulley or roller is associated with a pressure element, preferrably a pressure roller, being mounted for placement into an operating position and a receded position for example by means of a slide having externally accessible projections for placing the slide into one or the other position as far as the pressure roller is concerned. Also, the cassette includes brake means such as a spring biased brake element which can be moved from a brake position to a no brake or brake lifted position overcoming the respective spring bias and being latched into that no brake position.

This system therefor avoids the utilization of a ribbon exchange cassette that has to be discarded, and since the known exchange feature does no longer occupy space more space is available within the ribbon cassette as a whole. Moreover this cassette may remain permanently in the machine and is no longer a throw away item. The space gained by the inventive feature is utilized by increasing the length of the ribbon in the cassette which of course increases the ribbon capacity as such and increases the time between ribbon exchanges.

During exchange the ribbon as such is merely taken out of its paper wrapping inserted into the cassette whereupon the cover thereof is replaced. The insertion of the ribbon into the ribbon cassette is moreover made possible by the feature of having the pressure element removable from the operating position to an alternative position and from the outside. Also the brake element is retracted for a ribbon removal and insertion.

The utilization of a rotatably mounted pressure roll as a cooperating element as far as the drive pulley is concerned eliminates or at least reduces significantly the friction between the pressure engagement on one hand and the ribbon on the other hand. The provision of the slide as stated is of advantage because neither the pressure roll nor the slide occupy a significant amount of space and as far as the general construction of the cassette is concerned these elements do not establish a reduction in volume capacity for the cassette as far holding a sufficient amount of ribbon is concerned.

The slide is preferably provided with two projections projecting through separate openings in the cassette wall, one to serve as an externally accessible lever to shift the slide back and forth, and the other projection slides in an opening as stated to establish proper guidance of the slide. The slide generally should move longitudinally i.e. parallel to the long wall of the cassette and is preferably spring biased.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connecction with the accompanying drawings in which:

FIG. 1 illustrates a cassette casing 1 having a releasable cover 2; the construction being conventional in this regard. The cassette includes as a basic element an endless ink ribbon 3 which may be of a single color or multicolor configuration. The ribbon 3 may be wound on a spool with an open loop being about 15 cm long and spanning the open space between the legs 4 and 7 of the cassette. As far as the entrance side for the ribbon 3 as it is moved is concerned, this entrance is at the leg denoted by reference numeral 4. Drive elements are provided at this leg 4 including the driven and journaled roller, pulley or sheave 5 having a coupling or keying portion 6 which upon insertion of the cassette into an office machine will engage the corresponding coupling element and counter key or socket for being driven by the drive or one of the drives within the machine in which the cassette is inserted. The coupling structure may include a corresponding coupling element or an alternative one on the underside of the cassette. The exit side for the ribbon 3 is provided at leg 7 and ribbon 3 leaves the cassette in the direction 7*a*. A brake element 8 is provided in that leg 7 for engaging the ribbon 3 to maintain adequate tension in the portion 3*a* of the ribbon 3. The cover 2 is provided with recesses 2*a* bearing against projections 1*a* of the casing 1. Additionally, recesses 2*b* are provided for the roll 5 and the coupling portion 6, and there are recesses 2*c* for the locking elements 10.

Figure 1:
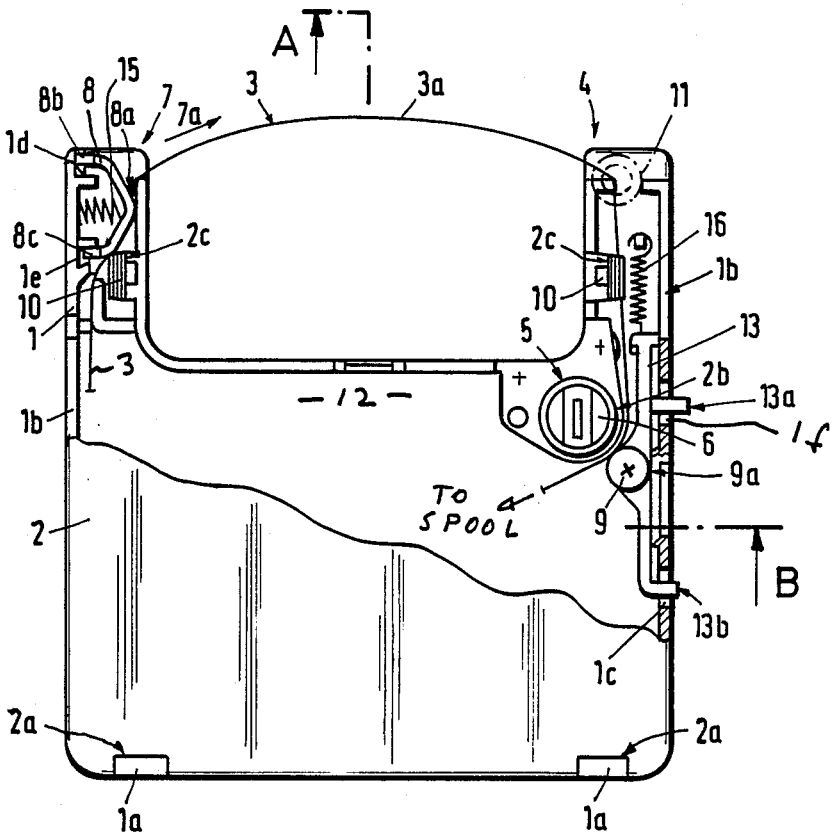
FIG. 1 is a top elevation of a ribbon cassette in operating position with partially removed cover.
Figure 2:
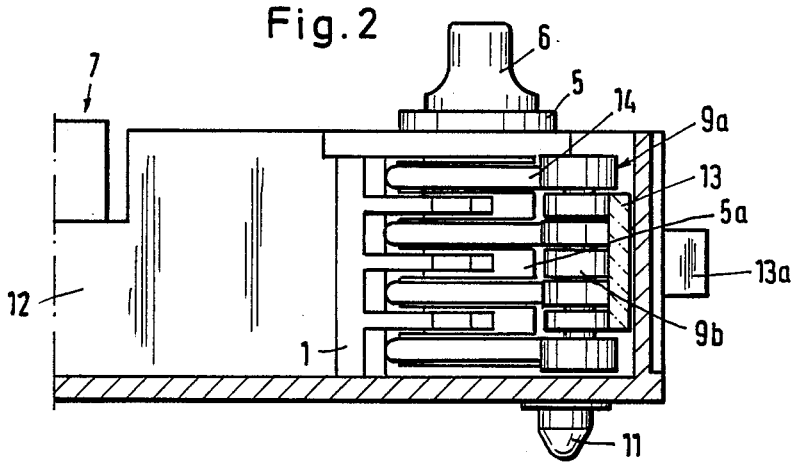
FIG. 2 is a vertical cross section taken along the line A-B in FIG. 1 (the left portion being mirror imaged). Proceeding now to the detailed description of the drawings

The cassette and here particularly the cassette casing 1 is positioned by means of centering pins 11 in the machine casing (printer,typewriter etc). The pressure element, being a roll 9 in the entrance leg 4 is located in the cassette so that the space 12 as illustrated is completely available for the endless ribbon 3. In the particular example illustrated the pressure roll 9*a* which is journaled and has an axis 9 of rotation that runs parallel to the axis of the driven roll 5. The pressure roll 9*a* is particularly mounted for rotation inside a slide 13 and has indents 9*b* cooperating with indents 5*a* of the juxtaposed driven roll or pulley 5. The effective sections of roll 5 are established through O-rings 14 made for example of a suitable synthetic (see FIG. 2). The height of the space 12 corresponds to the width of the endless ribbon 3 so that the cover 2 will in fact guide the ribbon 3 in the upper direction.

The slide 13 runs longitudinally i.e. parallel to the long casing wall 1*b*. The slide 13 is provided with at least two projections 13*a* and 13*b*. The projection 13*a* serves as an actuating lever and is externally accessible through an opening 1*f* in casing 1. The projection 13*b* cooperates with a longitudinal opening 1*c* in the casing 1 and serves as a guide for the slide 13. The slide 13 may be provided with additional projections or the like to obtain a latching feature for holding the slide 13 in a retracted position. The slide 13 moreover is subject to the force of a spring 16 which pulls or tends to pull the slide 13 in the longitudinal direction i.e. parallel to the sidewall 1*b* of the cassette and of the retracted position. The spring force thus tends to put the slide 13 into the operating position and is therefore constructed as tension spring.

The brake element 8 is likewise maintained in the operating position by means of a span in or latching elements 9*b* and 8*c* on one hand and latching indents 1*d* and 1*e* respectively on the other hand and being provided in the casing. The elements 8*b* and 8*c* when snapped into indents 1*d* and 1*e* maintain and hold the brake element 8, retracted from the operating position, but after release the compression spring 15 pushes the brake element 8 forwards thereby bridging the gap 8*a* to be placed into the operating position. For removing ribbon 3 and replacing it by a different one the effect of the spring 15 is offset by causing the brake element 8 to have its element 8*b* and 8*c* latched in the indents 1*d* and 1*e* respectively, the spring 15 bears against the inside of the brake element 8 and against the cassette casing sidewall 1*b*.

Having described the basic elements, it will now be described how an exchange of a spent ribbon 3 is accomplished including insertion of a fresh ribbon 3 following the removal of the spent one. The cassette itself stays in place in the machine. The pressure element 9*a* is retracted by pulling the slide 13 back and latching it into the retracted position or just by holding it back through lever 13*a*. The brake element 8 is retracted and latched into indents 1*d*, 1*e*. Sufficient clearance is now established which permits removal of the spent endless ribbon 3. The fresh ribbon 3 is merely taken from the box or the like in which it comes, and its leader being about 15 cm long is placed into the brake element gap 8*a* as well as in the now open gap between the pressure element 9*a* and the sheave 5. Thereafter brake element 8 and pressure element 9*a* are returned to the operating position of engagement with the ribbon 3 whereupon the lid or cover 2 is replaced.

The invention is not limited to the embodiments described above but all changes and modifications thereof, not constituting departures from the spirit and scope of the invention, are intended to be included.

We claim:

1. A ribbon cassette having a casing with a releasable cover comprising:

- a pulley mounted for rotation in said casing there being key-means projecting beyond the casing of the cassette for engagement with external drive means;
- a rotatably mounted pressure roller;
- a slide for movably mounting the pressure roller to obtain a first position of engagement with said pulley and a second retracted position;
- a projection on said slide and being externally accessible for shifting the slide from the first to the second position and vice versa, there being an opening in said casing through which the projection is externally accessible;
- an additional projection on said slide running in an opening in said casing for guiding movement of said slide along a long wall of the cassette casing;
- brake means disposed in said cassette; and
- a removable endless ink ribbon insertible and inserted in said casing and filling the casing essentially in its entirety, the ribbon running through a gap between the pulley and said pressure roller on one hand and said brake means on the other.

2. Cassette as in claim 1 and including a spring for spring biasing the slide towards attaining said first position.

3. Cassette as in claim 1 said brake means including a brake element externally movable into a brake and a no brake position, said brake element being biased by means of a spring, the removal from the brake position being carried out against the force of the spring, there being means for latching the brake element in the no brake position.

* * * * *